US006830025B2

(12) United States Patent
Leimer

(10) Patent No.: US 6,830,025 B2
(45) Date of Patent: Dec. 14, 2004

(54) DUAL SPRING VALVE STEM SEAL MODULE

(75) Inventor: Mark A. Leimer, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/408,995

(22) Filed: Apr. 8, 2003

(65) Prior Publication Data

US 2004/0200451 A1 Oct. 14, 2004

(51) Int. Cl.[7] ..... F01L 7/00
(52) U.S. Cl. ..... 123/190.17; 123/188.2
(58) Field of Search ..... 123/190.17, 188.2, 123/188.12, 188.17

(56) References Cited

U.S. PATENT DOCUMENTS 2,403,260 A 7/1946 Charles
3,577,972 A 5/1971 Moray
3,699,942 A 10/1972 Moray
6,237,549 B1 * 5/2001 Huff ..... 123/79 C

* cited by examiner

*Primary Examiner*—Tony M. Argenbright
*Assistant Examiner*—Katrina Harris
(74) *Attorney, Agent, or Firm*—Rader, Fishman & Grauer, PLLC

(57) ABSTRACT

A dual spring valve stem seal module utilizes an inner retention spring to incorporate a valve stem seal assembly, a valve spring and a spring retainer. The dual spring valve stem seal module reduces the inventory and simplifies the assembly required for the valve stem seal assembly, the valve spring and the spring retainer, thereby reducing the costs associated therewith.

14 Claims, 2 Drawing Sheets

DUAL SPRING VALVE STEM SEAL MODULE

TECHNICAL FIELD

The present invention relates to a valve stem seal assembly, and in particular to a seal for a valve stem seal assembly found in overhead valve internal combustion engines.

BACKGROUND OF THE INVENTION

Those skilled in the art will appreciate the manner in which intake and exhaust valves are employed in cylinder heads of internal combustion engines. In conventional overhead valve internal combustion engines, a pair of valves reciprocates in timed alternation to provide intermittent communication between the intake and exhaust manifolds and a combustion chamber. As is well known, the intake port of a combustion chamber is opened and closed by the reciprocating motion of at least one intake valve. The intake valve permits fuel mixed with air to flow into the combustion chamber. In addition, an internal combustion engine has at least one exhaust valve and associated exhaust port for releasing expended combustion gases into the atmosphere. Lubrication is provided to the upper portions of the valves. Because temperatures in the combustion chamber may approach or exceed 1000 degrees Centigrade, any lubricating oil exposed to these temperatures will vaporize or burn leaving behind deposits that may interfere with the proper sealing of the valves and cause rapid deterioration. Valve stem seal assemblies are used to seal against leakage of oil between each valve guide and its associated valve stem.

It is therefore necessary to provide seals around the upper region of the valve stems and along the valve guide down to the manifolds and combustion chamber. A typical valve stem seal takes the form of a cylinder partially closed at one end by the valve seal. The cylindrical region seats about the valve guide to maintain the valve seal stationary. An upper region of the valve stem is surrounded by the valve seal when the valve stem is fully inserted into the valve seal assembly.

Conventional valve seal assemblies comprise individual body and seal components that typically must be assembled into the valve seal assembly. In addition, the valve seal assembly, valve spring and spring retainer must be assembled individually by the end user. Further, the manufacturer must keep an inventory of the valve seal assembly, valve spring and spring retainer. The inventory of such multiple components and associated assembly increases the cost of the assembled valve seal assembly.

SUMMARY OF THE INVENTION

The inventor of the present invention has recognized these and other problems associated with valve stem seal assemblies. To this end, the inventor has developed a dual spring valve stem seal module comprising a valve spring having first and second ends, a valve stem seal retainer including a first raised edge and an annular flange for supporting said first end of said valve spring, a spring retainer having a second raised edge and retaining the second end of said valve spring and a retention spring captured by the first and second raised edges to form the valve stem seal module. The retention spring incorporates the valve stem seal assembly, the valve spring and the spring retainer to form the dual spring valve stem seal module.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
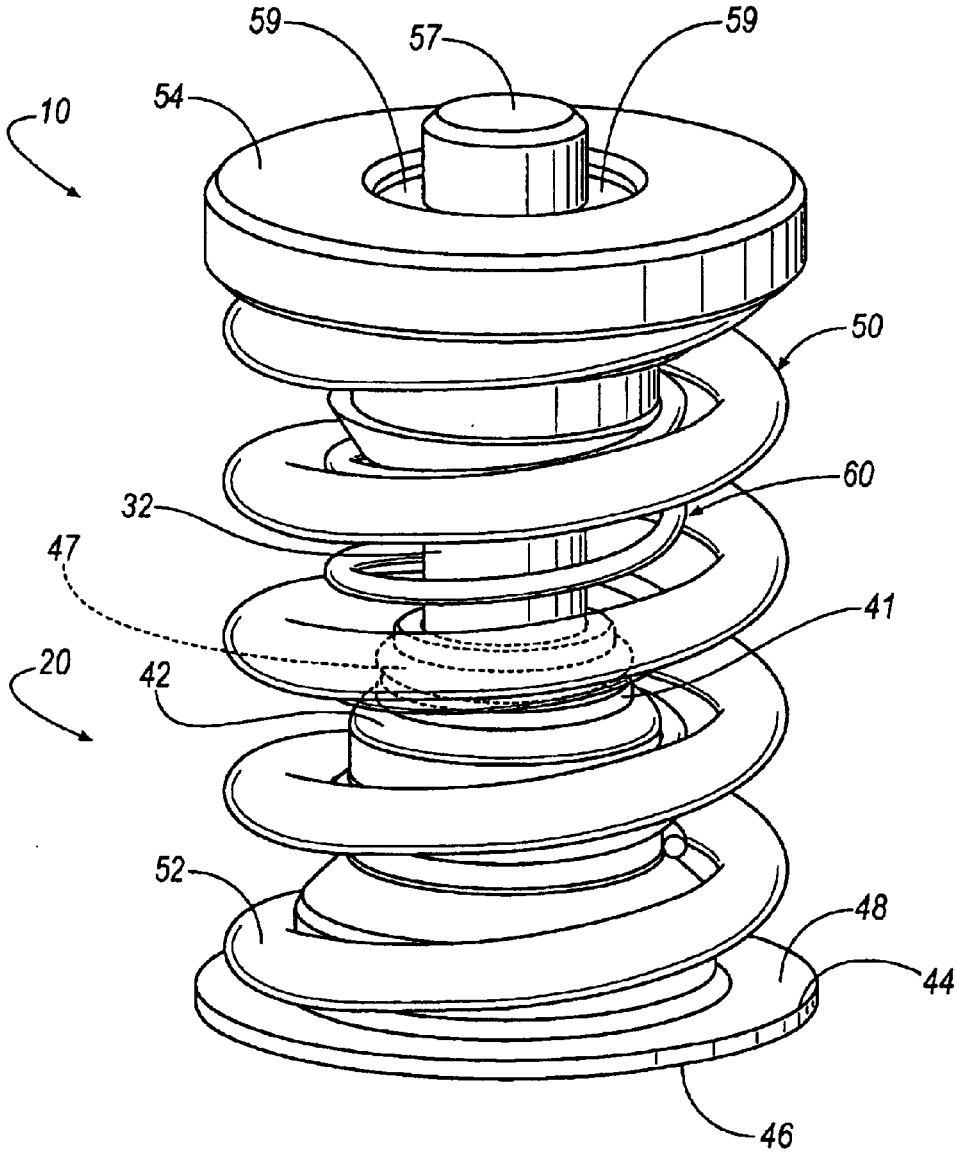
FIG. 1 is a perspective view of a dual spring valve stem seal module according to an embodiment of the invention.
Figure 2:
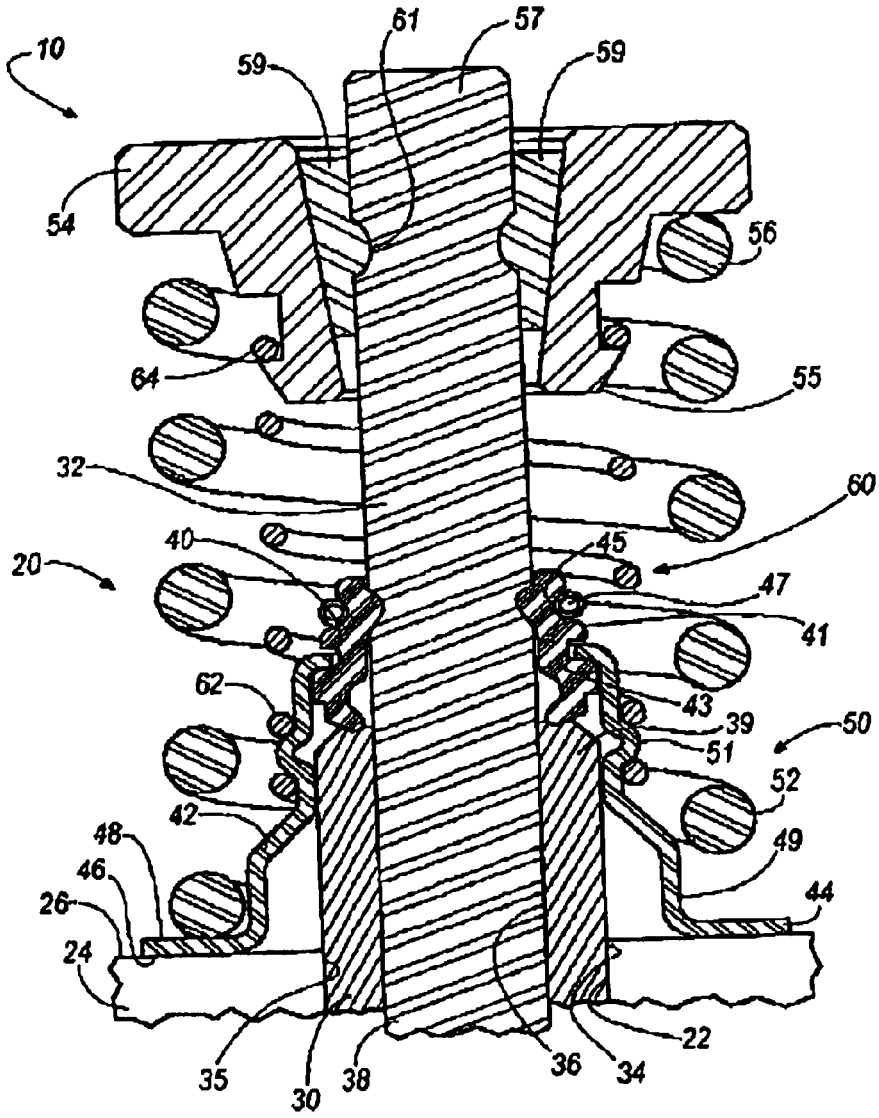
FIG. 2 is a cross-sectional view of the dual spring valve stem seal module of the invention.

Referring now to FIGS. 1 and 2, a dual sprig valve stem seal module, shown generally at 10, is shown according to an embodiment of the invention. The dual spring valve stem seal module 10 includes a valve stem seal assembly, shown generally at 20, that is adapted to be received in an axially extending bore 22 of an internal combustion engine component, such as an engine head 24. The engine head 24 includes an upper axial surface 26 and a lower axial surface (not shown).

The valve stem seal assembly 20 includes an annular valve stem guide 30 surrounding a valve stem 32. The valve stem guide 30 may comprise two distinct annular guide sections (not shown), and may be formed from powdered metal. The radially outer surface 34 of the valve stem guide 30 closely corresponds to the diameter of the bore 22 such that a very tight fit results between the valve stem guide 30 and the bore wall 35 when the valve stem guide 30 is inserted. Likewise, the diameter of the radially inner surface 36 of the valve stem guide 30 closely corresponds to the diameter of the radially outer surface 38 of the valve stem 32, resulting in a tight fit between the valve stem and the valve guide, though not so tight as to prevent the valve stem 32 from reciprocating within the valve stem guide 30. A resilient sealing member 40 about the upper end 39 of the valve stem guide 30 extends longitudinally over a portion of both the outer surface 38 of the valve stem 32, and over a portion of the outer surface 34 of the valve stem guide 30. As noted above, the sealing member 40 serves several purposes. First, sealing member 40 limits oil entry into the manifold and the combustion chamber. Second, sealing member 40 acts to minimize exhaust particulates that contribute to pollution. Third, sealing member 40 is helpful in minimizing wear of valve stem guide 30.

The sealing member 40 is held in place by an annular valve stem seal retainer 42, typically of metal construction. The sealing member 40 has an outer periphery surface 41 that includes a first circumferentially extending groove 43 and optionally includes a second circumferentially extending groove 45. An upper portion of the seal retainer 42 is received within the first circumferentially extending groove 43. A garter spring or R-ring 47 for biasing the inner sealing surface of the sealing member 40 radially inwardly may be received in the second circumferentially extending groove 45.

In addition, the seal retainer 42 is formed with an annular flange 44 having a bottom surface 46 that rests in facing relationship with the upper surface 26 of the engine head 24. The top surface 48 of the flange 44 acts a seat for an outer helical valve spring 50. It should be noted that seal retainer 42 may comprise both a seal retainer portion and a separate support in the form of a separate hardened washer (not shown). In such an arrangement, the hardened washer includes a flanged portion interposed between lower portion 52 of the valve spring 50 and the upper surface 26 of the engine head 24, thereby providing a seat for the valve spring 50.

In addition, an upper spring retainer 54 of conventional design restrains the upper portion 56 of the valve spring 50. The upper spring retainer 54 is removably attached to an upper portion 57 of the valve stem 32 by one or more keepers 59 that cooperate with a circumferentially extending groove 61 such that spring retainer 54 reciprocates with valve stem 32, thereby compressing the valve spring 50.

One aspect of the invention is that the outer surface 49 of the seal retainer 42 is formed with a circumferentially extending raised edge 51 that acts as a seat for the lower portion 62 of an inner helical retention spring 60. In addition, the upper spring retainer 54 includes a circumferentially extending raised edge 55 that acts as a seat for the upper portion 64 of the retention spring 60. The raised edges 51, 55 captures the retention spring 60 to form the dual spring valve stem seal module 10 comprised of the valve stem seal assembly 20, the valve spring 50 and the upper spring retainer 54. As shown in FIGS. 1 and 2, the diameter of the retention spring 60 is less than the diameter of the spring 50 such that the retention spring 60 resides within the spring 50. In this manner, the retention spring 60 does not interfere with the compression of the valve spring 50 during reciprocation of the valve stem seal assembly 20.

The retention spring 60 provides a biasing force that is necessary for incorporating the valve stem seal assembly 20, the valve spring 50 and the upper spring retainer 54 into a single dual spring valve stem seal module 10 of the invention. By incorporating the valve stem seal assembly 20, the valve spring 50 and the upper spring retainer 54 into a single dual spring valve stem seat module 10, the inventory required by the manufacturer is reduced and the assembly required by the end user is made simpler as compared to conventional valve stem seal assemblies, thereby reducing the costs associated therewith.

It should be understood that the aforementioned and other various alternatives to the embodiments of the invention described herein may be employed in practicing the invention. It is intended that the following claims define the scope of the invention and that the method and apparatus within the scope of these claims and their equivalents be covered thereby.

What is claimed is:

1. A dual spring valve stem seal module, comprising:

a valve spring having first and second ends;

a valve stem seal retainer for supporting said first end of said valve spring, said valve stem seal retainer including a first raised edge;

a spring retainer for supporting the second end of said valve spring, said spring retainer having a second raised edge; and a retention spring captured by the first and second raised edges to form the valve stem seal module.

2. The dual spring valve stem seal module according to claim 1, wherein a diameter of said retention spring is less than a diameter of said valve spring.

3. The dual spring valve stem seal module according to claim 1, wherein said valve stem seal retainer includes an annular flange for supporting said second end of said valve spring.

4. The dual spring valve stem seal module according to claim 1, further comprising one or more keepers for removably attaching a valve stem to said spring retainer.

5. The dual spring valve stem seal module according to claim 1, further comprising a sealing member having an outer periphery surface including first and second circumferentially extending grooves.

6. The dual spring valve stem seal module according to claim 5, wherein a upper portion of said seal retainer is received within said first circumferentially extending groove.

7. A dual spring valve stem seal module, comprising:

a valve spring having first and second ends;

a valve stem seal retainer for supporting said first end of said valve spring;

a spring retainer for supporting the second end of said valve spring; and a retention spring having first and second ends captured by said spring retainer and said valve stem seal retainer, thereby forming said valve stem seal module.

8. The dual spring valve stem seal module according to claim 7, wherein said valve stem seal retainer and said spring retainer include first and second raised edges, respectively, for capturing said first and second ends of said retention spring.

9. The dual spring valve stem seal module according to claim 7, wherein a diameter of said retention spring is less than a diameter of said valve spring.

10. A dual spring valve stem seal module, comprising:

a valve spring having first and second ends;

a valve stem seal retainer for supporting said first end of said valve spring, said valve stem seal retainer including a first raised edge;

a spring retainer for supporting the second end of said valve spring, said spring retainer having a second raised edge;

a retention spring captured by the first and second raised edges to form the valve stem seal module;

a sealing member having an outer periphery surface including first and second circumferentially extending grooves; and whereby a garter ring is received in said second circumferentially extending groove for biasing said sealing member radially inward.

11. The dual spring valve stem seal module according to claim 10, wherein a diameter of said retention spring is less than a diameter of said valve spring.

12. The dual spring valve stem seal module according to claim 10, wherein said valve stem seal retainer includes an annular flange for supporting said second end of said valve spring.

13. The dual spring valve stem seal module according to claim 10, further comprising one or more keepers for removably attaching a valve stem to said spring retainer.

14. The dual spring valve stem seal module according to claim 10, wherein an upper portion of said seal retainer is received within said first circumferentially extending groove.

* * * * *